United States Patent [19]

McBride et al.

[11] Patent Number: 4,692,346

[45] Date of Patent: Sep. 8, 1987

[54] METHOD AND APPARATUS FOR CONTROLLING THE SURFACE CHEMISTRY ON OBJECTS PLATED IN AN ELECTROLESS PLATING BATH

[75] Inventors: Donald G. McBride, Binghamton; Robert G. Rickert, Endwell, both of N.Y.

[73] Assignee: International Business Machines Corporation, Armonk, N.Y.

[21] Appl. No.: 854,262

[22] Filed: Apr. 21, 1986

[51] Int. Cl.[4] ..... C23C 3/02

[52] U.S. Cl. ..... 427/8; 427/9; 427/10; 427/345; 427/143.1

[58] Field of Search ..... 427/8-10, 427/345, 443.1

[56] References Cited

U.S. PATENT DOCUMENTS 4,331,699 5/1982 Suzuki ..... 427/443.1

4,623,554 11/1986 Kaschak ..... 427/8

4,626,446 12/1986 Capwell ..... 427/8

*Primary Examiner*—John D. Smith

*Attorney, Agent, or Firm*—Pollock, Vande Sande & Priddy

[57] ABSTRACT

A method and apparatus for controlling surface chemistry on objects plated in an electroless plating bath. Cyclic voltammetry measurements are made for different pH conditions of the bath. Pourbaix diagrams are determined from these measurements which indicate the transition between metal species being plated by the bath. The open circuit potential of the bath is monitored by a potentiostat and compared with a setpoint open circuit potential which represents a desired metal species on the pourbaix diagram. The monitored open circuit potential and the setpoint are utilized to derive an error voltage. The error voltage will control the concentration of a chemical constitutent of the plating bath to maintain the desired method species on the plating surface.

10 Claims, 6 Drawing Figures

METHOD AND APPARATUS FOR CONTROLLING THE SURFACE CHEMISTRY ON OBJECTS PLATED IN AN ELECTROLESS PLATING BATH

The present invention relates to the electroless plating art. Specifically, an apparatus and method for monitoring and controlling the surface chemistry of objects being plated in an electroless plating bath are described.

Electroless plating baths are utilized in the manufacture of integrated circuits to copper plate substrate circuit interconnections. The quality of plating circuit interconnections depends on maintaining the chemistry of the bath under control such that the metal species at the surface of the component being plated is maintained constant.

The electroless plating bath chemistry will change over time such that the metal species being plated out will change from the desired species CU in an additive copper plating bath, to an intermediate phase of $CU_2$ and $CU_0$. Additionally, contaminants will form on the plated surface over time which, when a critical level is reached, reduces the adhesion of copper to the circuit connections.

Restoration of the proper surface chemistry on plating surfaces requires a rebalancing of the bath chemistry as well as control over such plating conditions as plating rate and bath temperatures.

The present invention seeks to provide real time control over the bath chemistry and plating rate in order to maintain the proper metal species on the plated surface.

SUMMARY OF THE INVENTION

It is an object of this invention to accurately control the chemical state of an electroless plating bath.

It is a more specific object of this invention to provide a method for monitoring the surface chemistry of an object being plated through cyclic voltammetric measurements.

It is an even more specific object of this invention to monitor and control surface chemistry of a plating bath to maintain a particular metal species at the surface of an object being plated.

These and other objects of the invention are provided by a computer controlled apparatus and process which continually monitors the phases of a metal species on the surface of an object to be plated. Cyclic voltammetry measurements are conducted on a sample of an electroless plating bath. Pourbaix diagrams of the bath are made from the voltammetry measurements and from measurements of the bath pH.

The electroless plating bath is controlled by establishing a setpoint on the poubaix diagram which identifies a proper metal species present on the plating surface. The setpoint is defined by an open circuit potential for a desired bath pH.

During electroless plating of circuit substrates open circuit potential mesurements are made in the bath. These measurements are compared with the desired setpoint to determine the bath chemistry. A control signal is developed which will change the concentration of one of the chemical constituents of the bath to achieve an open circuit potential identified by the setpoint. Thus, the metal species identified by the setpoint is maintained during the electroless plating of the circuit substrate.

In a preferred embodiment of the invention, the contaminant level and plating rate of the electroless plating bath are also monitored. The complex impedance measured between the reference electrode and working electrode of a potentiostat used to make cycle voltammetry measurements are resolved into real and imaginary components. The real component is proportional to the reciprocal of the plating rate while the imaginary component is proportional to the contaminant level of the plating bath. The computer controlled apparatus and method will signal the system operator of the presence of an excessive contaminant level.

In the preferred embodiment of the invention, a plating rate setpoint is also entered by the system operator in the control computer. Comparisons between the measured plating rate and setpoint plating rate are made to derive a control signal which will control the concentration of another chemical constituent of the electroless plating bath reducing the difference between the measured plating rate and setpoint plating rate.

DESCRIPTION OF THE PREFERRED EMBODIMENT

Method and apparatus in accordance with the present invention provide for accurate control or the chemistry of metal species plating on a surface in an electroless plating bath. The process and apparatus in accordance with the present invention controls the metal species chemistry by analyzing the bath chemistry with cyclic voltammetric measurements. The measurements are utilized to generate pourbaix diagrams which indicate the interface between phases of metal species on the surface of an object being plated in the electroless plating bath.

Figure 1:
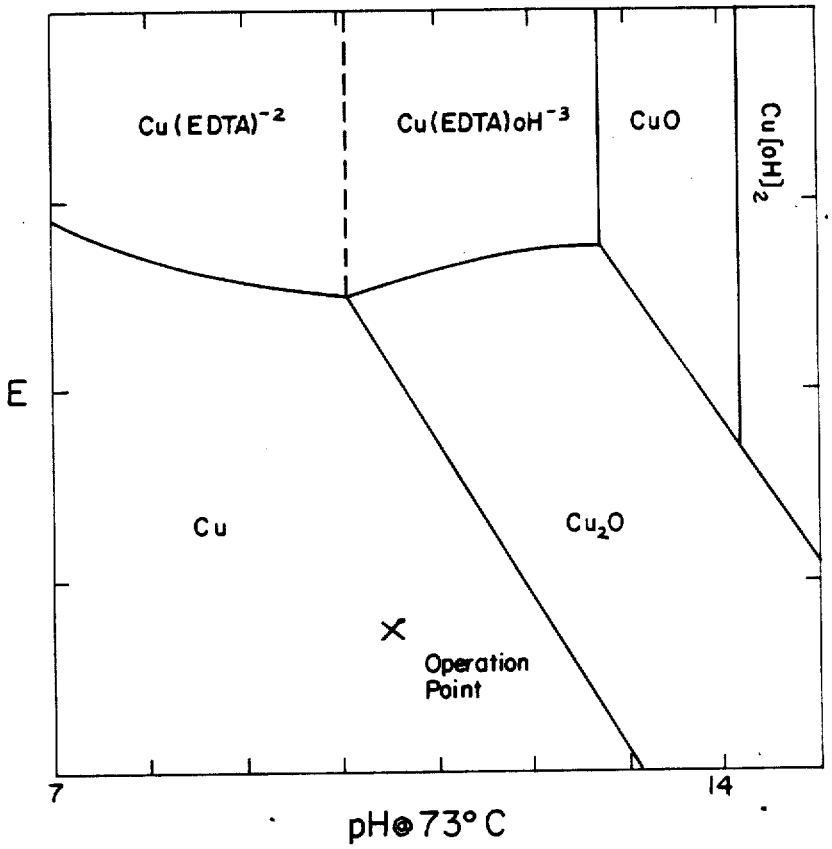
FIG. 1 is an illustration of the pourbaix diagram which demonstrates the various phases of copper metal species in a copper electroless plating bath as a function of pH levels and electrical potential.

Referring to FIG. 1, there is a pourbaix diagram showing the relationship between an open circuit potential detected in the bath versus pH concentration at a particular temperature identified as 73° C. The various phases of chemical constituents in the bath can be seen in the diagram. By maintaining the open circuit electrical potential with respect to a given pH level during plating at a specific operation point, shown to be that range below the transition from copper to one of the other metal species plated by the bath, control over the surface metal species being plated is obtained.

Additional control over the plating process is accomplished by controlling a plating rate with respect to an ideal plating rate setpoint defined by the system operator. This plating rate control is effected by varying the concentration of constituent products of the plating bath in accordance with the difference between the setpoint plating rate and a measured plating rate.

An additional feature of the present invention includes the measurement of contaminant levels of the plating bath. By measuring the capacity between a plated object and a probe, the particular contaminant level of the plating bath may be monitored. The measurement of the capacitance between an object being plated and a probe in the electroplating bath may be determined through a complex AC impedance measurement technique. The reactance portion of the measured impedance determines the capacitance while the resistive component may be utilized to determine the plating rate.

Figure 2:
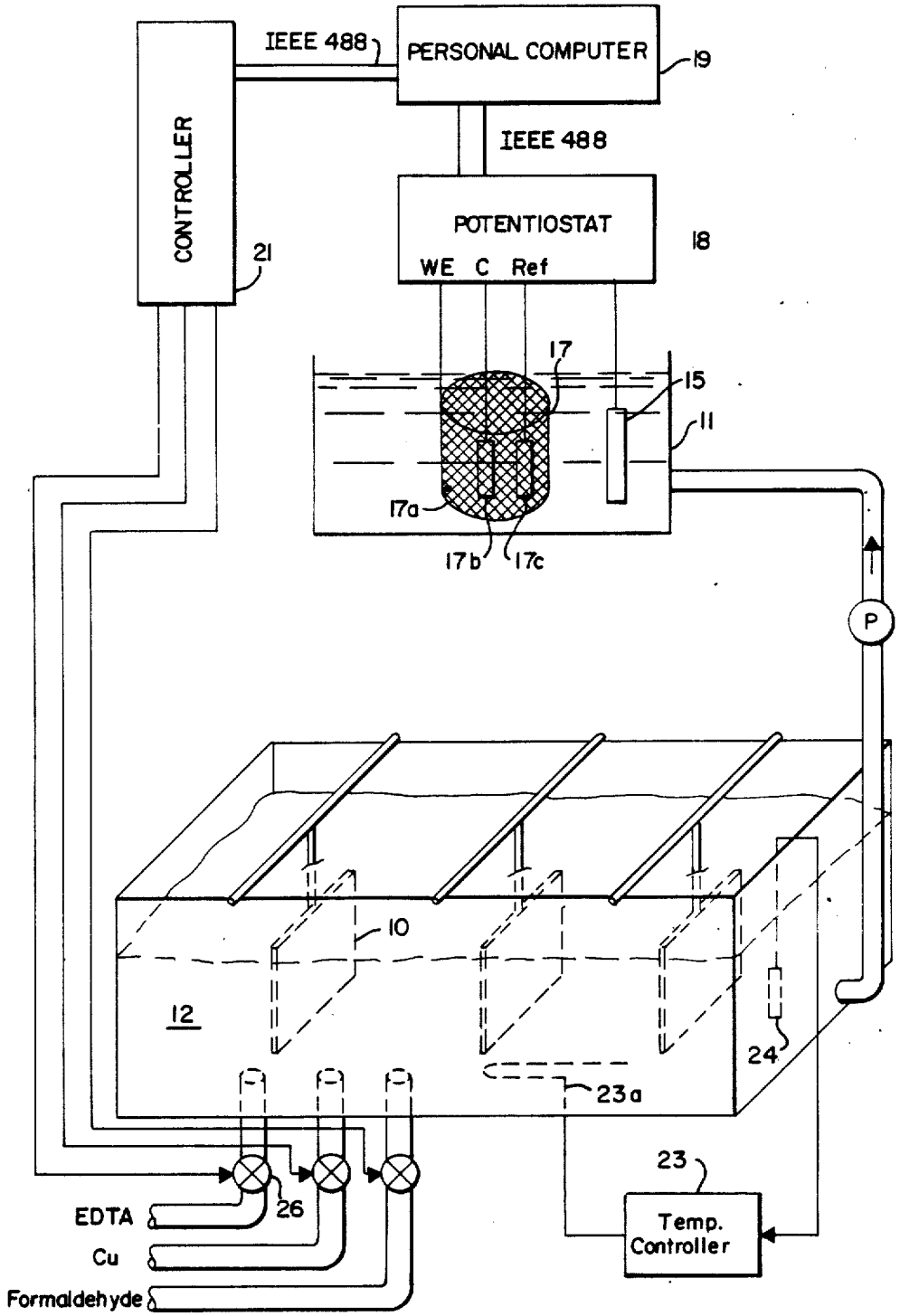
FIG. 2 is an overall block diagram of an apparatus for generating pourbaix diagrams and controlling the bath chemistry in an electroless plating bath.

Referring now to FIG. 2, there is shown the apparatus which will determined from cyclic voltammetric measurements the chemistry of a metal species being plated on the surface of an object in the bath.

A test sample container 11 is connected via a pump to the main plating bath tank 12. The test bath container includes a pH sensor 15 as well as the electrodes 17*a*, 17*b* and 17*c* of a potentiostat 18. The electrodes of the potentiostat 18 comprise a working electrode 17*a* which serves as a plating receptor, a counter electrode 17*b* for forming with a working electrode, a current path through the electroless plating bath, and a reference electrode 17*c*. A potentiostat 18 which may be, for instance, a Model 173 EG & G Potentiostat/Galvanostat known to those skilled in the art, is connected to the electrodes 17*a*, 17*b* and 17*c*.

The potentiostat 18 includes a digital output which is compatible with an IEEE 488 communication link. The output of the potentiostat 18 is connected to a computer 19 which may be a personal computer configured to receive the IEEE 488 interface.

The computer 19 is programmed in a manner to be explained to make measurements via the potentiostat electrodes 17*a*, 17*b* and 17*c* which generate the required pourbaix diagrams based on the voltammetry measurements. Additionally, the program of the personal computer 19 will control the potentiostat 18 to make contaminant measurements via a capacitance measurement between electrodes, as well as a plating rate determination by measuring the real component of the impedance measured between the potentiostat electrodes 17*a*, 17*b* of the electroless plating bath.

The other function of the personal computer 19 is to establish a setpoint for controlling the plating object surface chemistry of the electroless plating bath, as well as a setpoint for the plating rate of the electroless plating bath. The personal computer 19 will compare the plating surface chemistry measurements taken on a real time basis with the plating surface setpoints and provide commands to a controller 21 which will adjust the bath chemistry in a direction to minimize the difference between the setpoints and measured quantities. The control over the electroless plating bath is effected by changing the concentration of at least one of the constituent components of the electroless plating bath. A typical copper plating bath for which the present invention is useful is defined in accordance with the following physical and chemical properties:

bath temperature: 73° (between 70° and 80° preferable range)
plating rate: 100–200 mils per hour
EDTA concentration: 35–50 grams per liter
cyanide concentration: 5–45 parts per million
copper concentration: 5–20
specific gravity: 1.05–1.08
pH: 11.0–13.0
formaldehyde concentration: 0–19 grams per liter The foregoing bath is used for copper plating an object such as a circuit substrate 10 disposed in the main electroplating bath 12 and which receives plating material from the bath. The electroless plating bath is maintained at a constant temperature with a temperature controller 23, connected to a heating element 23*a*, which will control the bath temperature in accordance with a temperature sensed by a temperature transducer 24.

Figure 3:
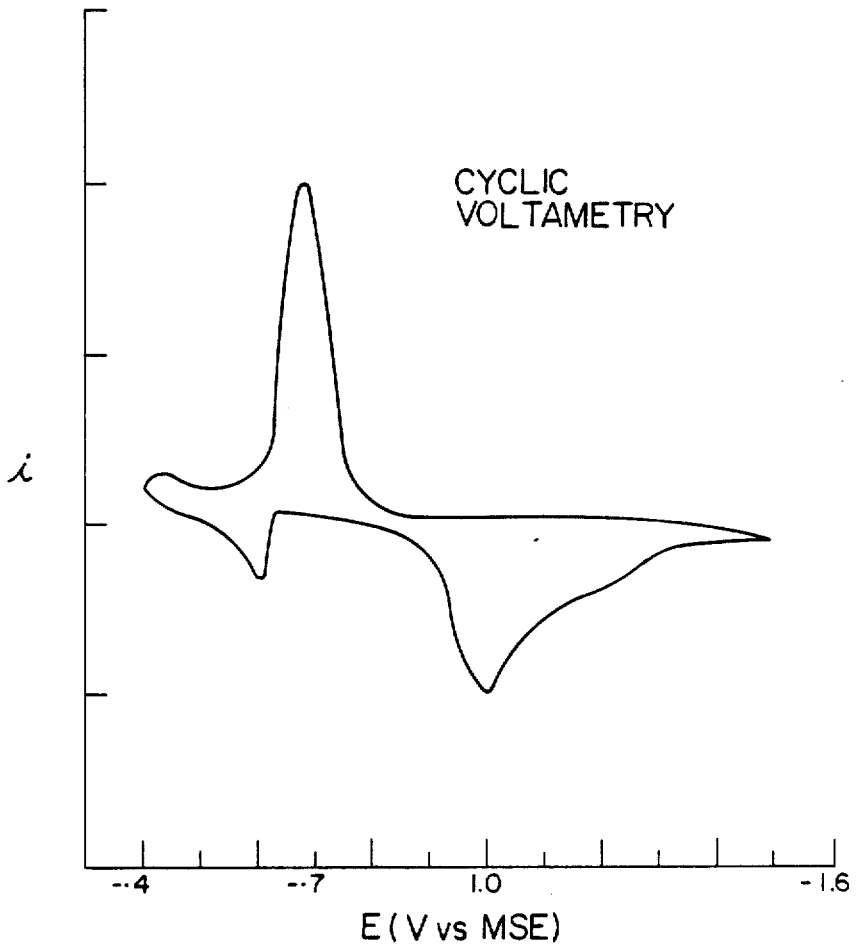
FIG. 3 demonstrates for a given pH level of a copper electroless plating bath the open circuit potential for a detected phase transition of copper in an electroless plating bath.

The potentiostat 18 will provide a current source between the counter electrode 17*b* and the working electrode 17*a*. The reference electrode will be continuously monitored and the potential of the reference electrode with respect to the working electrode used to provide in accordance with FIG. 3 a current versus open circuit electric potential curve. The current represented in FIG. 3 as the ordinate demonstrates certain peaks, one occurring at approximately an open circuit potential of 0.7 volts and the other at an open circuit potential of 1.0 volts. These current peaks correspond for a given pH of the electroplating bath to a condition of transition between phases of the metal species in the bath. Thus, for a given pH, the two points lying on the phase transition curves of FIG. 1 are located.

As the pH of the electroless plating bath changes, additional cyclic voltametric measurements can be made, such as to produce the pourbaix diagrams of FIG. 1. The cyclic voltammetry provides a current drive to the counter and working electrode such that a 400 millivolt sweep is produced at the reference electrode.

The open circuit potential setpoint entered into the personal computer defines a point on the pourbaix diagram within the region in which the copper metal species CU is being plated. Typically, for the aforementioned electroless plating bath, the setpoint is approximately 50 to 70 millivolts below the determined transition phase for copper to the CU+ phase.

Control over the open circuit potential as identified on the pourbaix diagrams is accomplished by controlling the EDTA concentration of the electroless plating bath. Referring to FIG. 2, a valve 26 is operated under control of the controller 21 to permit a higher concentration of EDTA to be effected, thereby maintaining the electroless plating bath within the aforesaid 50–70 millivolt range of the phase transition. The controller 21 is a Model 2400B Fluke controller which interfaces via an IEEE 488 interface. The controller 21 will provide an output which can be a stepper motor controller such as to control valve 26 associated with the EDTA reservoir.

Thus, from cyclic voltametric measurements, the open circuit potential of the electroless plating bath may be determined. The open circuit potential indicates the metallic surface chemistry appearing on the working electrode 17*a*, corresponding substantially to the metallic chemistry appearing on the object of interest 10 being plated in the main electroplating bath.

Other measurements and control effected by the apparatus of FIG. 2 include determining a plating rate, and from that plating rate and a selected input setpoint plating rate, determining a bath chemistry which will reduce the difference between the measured and setpoint plating rate.

Figure 4:
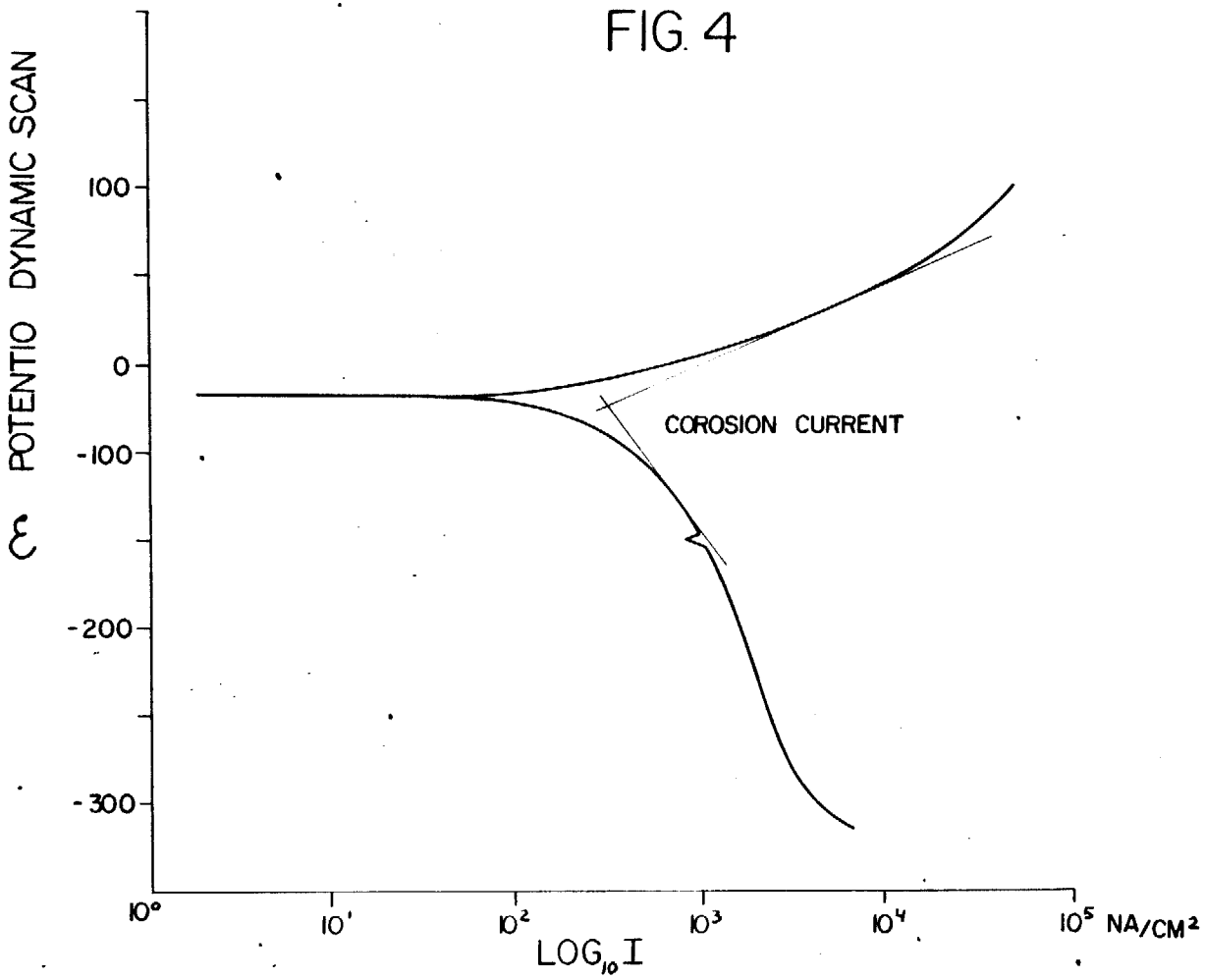
FIG. 4 illustrates a potentio dynamic scan performed by the potentiostat of FIG. 2 for determining the plating rate of the electroless plating bath.

The apparatus of FIG. 2 may calculate the plating rate by one of two methods. The first is a method based on potentiodynamic measurements effected by the potentiostat 18. The current drive between the counter and working electrode is cycled from a level of 0 amps upwards, such that the open circuit potential varies between −0.5 and +0.5 volts. The log of the resulting function where E is plotted as the ordinate and the log of the current is plotted as the abscissa will define a corrosion current which is known to be proportional to the plating rate. Referring now to FIG. 4, there is shown a plot of the aforementioned type wherein the corrosion current is seen to be defined by two lines tangent to each side of a 0 current reading. The function E versus log I is symmetrical about the 0 current point, such that two lines may be drawn, tangent to each side of a function which is symmetrical to the 0 current point. The intersection of the tangent lines defines the aforesaid corrosion current which is known to be proportional to the plating rate.

A more convenient and preferable way of determining the plating rate relates to a polarization measurement. The open circuit voltage between the reference electrode and working electrode may be represented as a linear function of the current between the working electrode and counter electrode. That line function has a slope which is proportional to the reciprocal of the plating rate of the electroless plating bath. This plating rate measurement may be combined with a capacitance measurement between the working electrode and reference electrode, which will indicate the parameter RHO. The RHO parameter is an indication of the contaminant level in the bath. The RHO function may be used to determine when the level of contaminants is excessively high, thus warning the system operator to change the electroless plating bath.

The plating rate and RHO parameter may be determined by taking AC impedance measurements between the reference and working electrode of the potentiostat. The real portion of this complex impedance measurement represents the change in resistivity with current, thus being proportional to the reciprocal of the plating rate. The imaginary portion of this complex impedance method identifies the capacitance which is proportional to RHO appearing at the surface of the working electrode which is receiving copper plating. When the RHO level becomes excessive to indicate a contaminant level which is above a maximum permissible level, the computer 19 can indicate that condition to the system operator.

Figure 5:
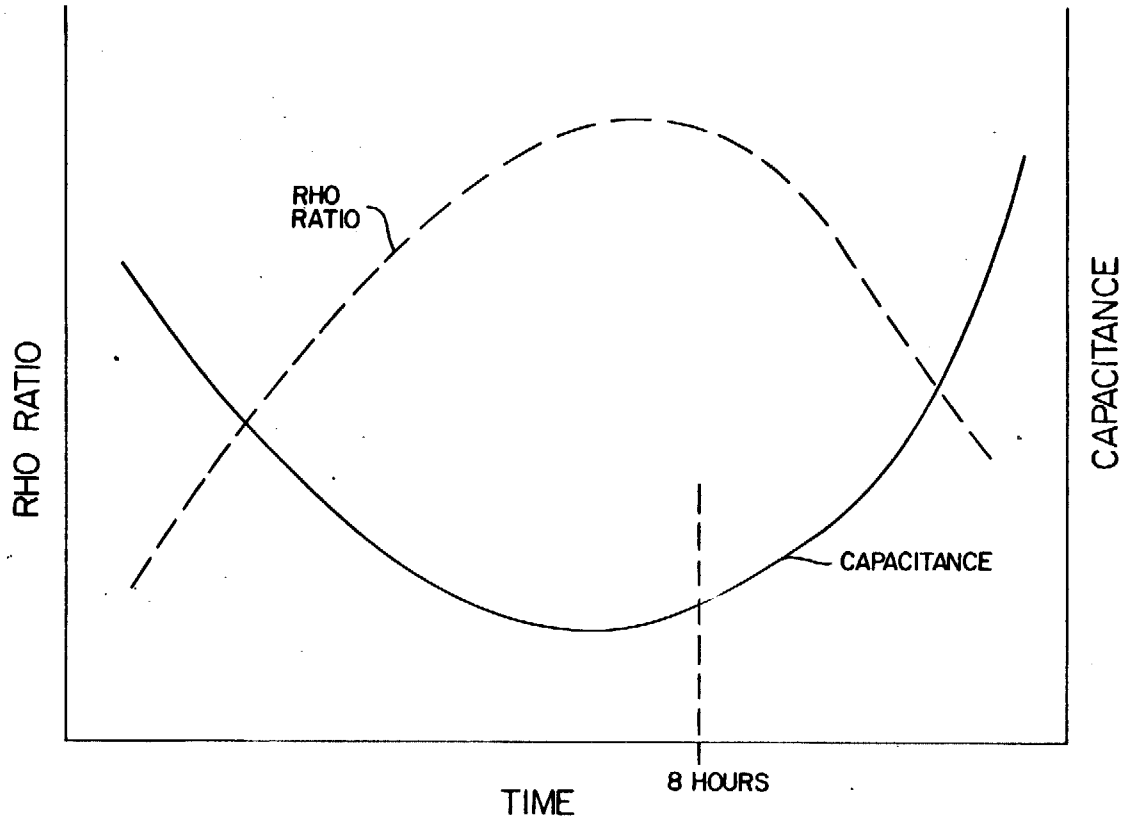
FIG. 5 demonstrates the relationship between measured capacitance between working electrode and reference electrode and the Rho ratio.

Referring to FIG. 5, the relationship between RHO and measured capacitance is demonstrated, permitting the capacitance measurement to serve as a basis for detecting the magnitude of the RHO parameter.

Figure 6:
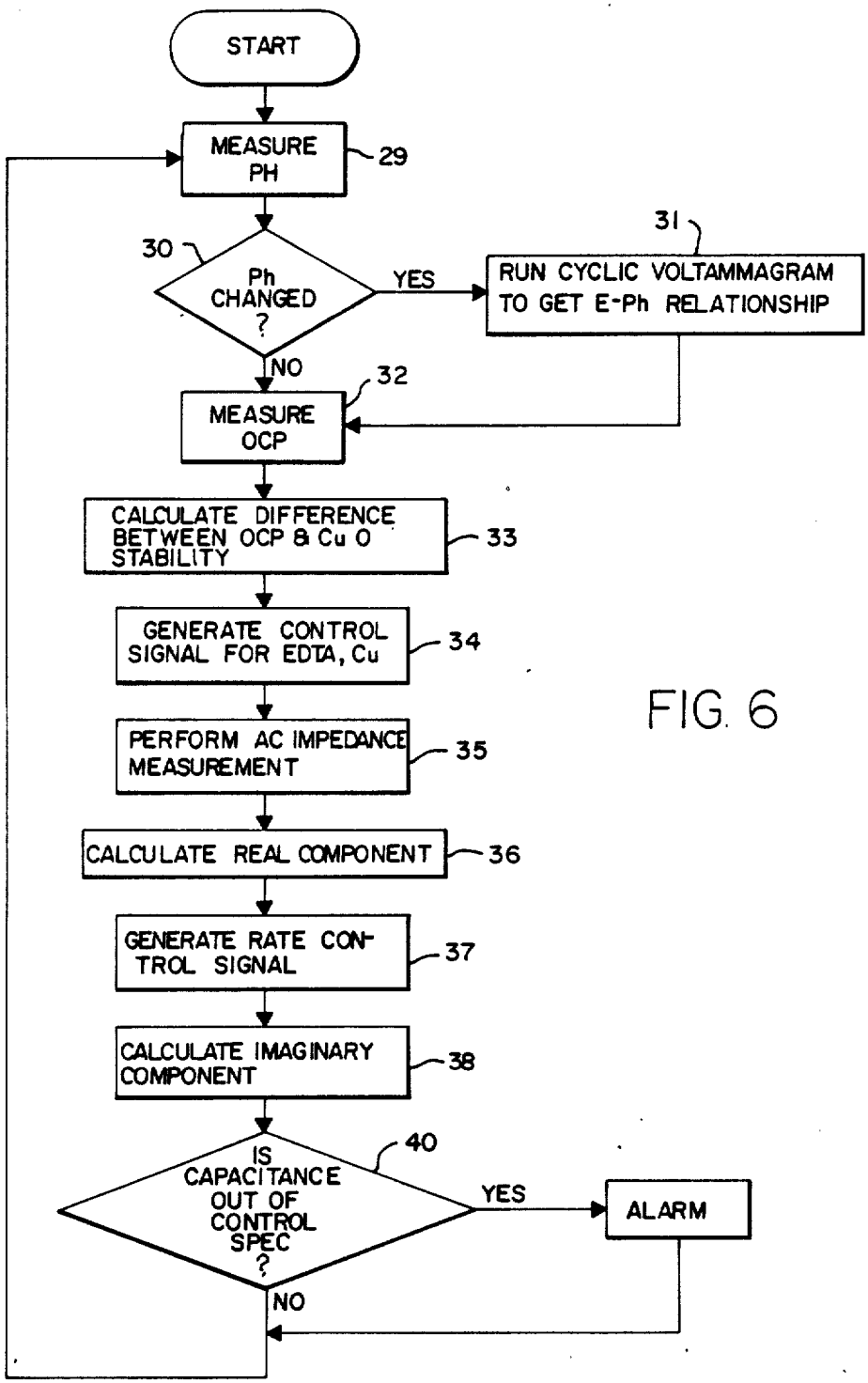
FIG. 6 is a flow chart illustrating program steps executed by the computer 19 of FIG. 2.

The system operation of the apparatus of FIG. 2 will now be described in terms of the programming steps executed by the personal computer 19. The flow chart illustrating those program steps is shown in FIG. 6. At the beginning of the program, a measurement of the pH level is determined in step 29 by sensing with standard pH measurement instrumentation the pH level of the electroless plating bath. When the pH level changes, decision block 30 will indicate the requirement to run the cyclic voltammogram to determine a new open circuit potential versus pH level.

When the relationship is determined, the open circuit potential is again measured in instruction 32, and a difference between the setpoint inputted by the system operator and the measured open circuit potential is determined. From this difference step 34 will generate a control signal for the controller to change the concentration of the EDTA level as required to reduce the difference between the setpoint open circuit potential and measured open circuit potential.

The computer 19 will then instruct the potentiostat 18 to perform the AC impedance measurements wherein an AC potential is applied to the counter electrode **17*a* and working electrode 17*b*. The real component of the measured impedance is determined in step 36**, which is proportional to the reciprocal of the plating rate. From a plating rate setpoint, entered into the computer by the system operator, a rate control signal is generated for controlling another constituent of the electroless plating bath. Typically, this will be the formaldehyde constituent to reduce the difference between the setpoint plating rate and the measured plating rate.

The determination of the level of contaminants, as measured by the RHO parameter is executed in step 38. The imaginary component of the impedance measurement which was taken representing the capacitance between the working electrode and counter electrode is compared with a control specification impedance component. Decision block 40 will indicate an alarm condition on the PC display when the level of capacitance is outside of the permissible range.

The system which functions in accordance with the flow chart of FIG. 6 will continually measure pH, and when pH levels have been detected as changing, run additional cyclic voltammograms. Subsequent open circuit potential measurements will define additional points on the chemical boundary phases which constitute the pourbaix diagrams for additional pH conditions. Thus, during system operation, the surface chemistry on the plating object is continuously monitored and the bath chemistry altered to maintain the proper metallic chemistry at the surface.

Thus, it is seen that the invention implemented by the apparatus of FIG. 1 will provide for accurate control of the metallic chemistry on the surface of objects being plated in an electroless plating bath, as well as control plating rate and monitor contaminant levels in the plating bath. Those skilled in the art will recognize yet other embodiments of the invention which are described by the claims which follow.

What is claimed is:

1. A method for controlling the chemical state of an electroless plating bath comprising:

immersing a plating working electrode, counter electrode and reference electrode in said plating bath;

applying a varying electrical potential between said plating working electrode and counter electrode;

measuring each current peak produced in response to said varying electrical potential, whereby the transition state of a chemical component being plated by said bath for a present pH level of said bath is identified, and storing the open circuit voltage measured between said reference electrode and said plating working electrode for each measured current peak;

monitoring the open circuit potential between said working electrode and said reference electrode during plating of an object, whereby the chemical phase of said chemical component being plated is continuously monitored; and changing the concentration of said chemical constituent of said bath to maintain a predetermined voltage differential between the open circuit potential and a setpoint voltage level whereby the chemical state for said chemical component remains the same.

2. The method of claim 1 further comprising:

detecting said current peaks over a range of pH values of said current bath, whereby a phase state plot is obtained for at least one of said bath constituent chemicals being plated from each measured open circuit reference electrical voltage which occurs for each of said pH values when a current peak between said plating working electrode and counter electrodes is produced; and comparing said open circuit voltage over said range of pH values during plating with a setpoint voltage identifying a preferred surface chemistry, and controlling said concentration of one of said chemical constituents to maintain a constant differential between said setpoint circuit voltage and said voltages comprising said phase state plot.

3. The method of claim 1 further comprising measuring the rate of electroplating of said electroless plating bath.

4. The method of claim 3 wherein said method for measuring the electroplating rate comprises;

determining the log of the current produced by said varying electrical potential applied between said plating object and counter electrode as a function of a measured open circuit potential between said reference electrodes and said plating working electrode;

determining the intersection of first and second lines tangent to each half of the function defined by the log of the current versus reference potential function, each of said halves being symmetrical about an open circuit potential where said log current function equals zero, said intersection defining a corrosion current level proportional to said plating rate.

5. The method according to claim 3 wherein said method of measuring the plating rate comprises:

applying a plurality of different voltage potentials between said counter electrode and said plating object, and measuring the current produced in response to each voltage;

measuring each reference electrode to plating object voltage potential corresponding to each measured current level;

determining the slope of a line function defined by said measured voltage potentials and responsive currents; and determining from the inverse of said slope the rate of plating.

6. The method according to claim 1 wherein said varying electrical potential varies over a range of 400 millivolts.

7. The method of claim 1 further comprising:

measuring the capacitance between said counter electrode and said plating object; and determining the level of bath impurities from said capacitance measurement.

8. A method for controlling the chemical phase of a chemical constituent of an electroless plating bath comprising:

detecting through cyclic voltammetry a plurality of peak current levels flowing between first and second electrodes immersed in said bath, and a corresponding open circuit voltage potential between a third electrode and said second electrode;

generating from said open circuit voltage measurements a dynamic E-pH function for one of said bath chemical constituents;

monitoring the open circuit potential between said second electrode and said third immersed electrode;

monitoring the pH of said electroless plating bath; and maintaining said open circuit potential measured at each monitored pH level at a predetermined differential with respect to said dynamic E-pH function by controlling the concentration of one of said bath chemical constituents.

9. The method according to claim 8 further comprising maintaining the plating rate of said bath substantially constant.

10. The method according to claim 9 wherein said plating rate is controlled by changing the concentration of another chemical constituent of said bath.

* * * * *

UNITED STATES PATENT AND TRADEMARK OFFICE

CERTIFICATE OF CORRECTION

PATENT NO. : 4,692,346

DATED : September 8, 1987

INVENTOR(S) : McBride et al

It is certified that error appears in the above-identified patent and that said Letters Patent is hereby corrected as shown below:

In column 4, line 1, after "5-20" insert --grams per liter--.

Signed and Sealed this

Fourteenth Day of June, 1988

*Attest:*

DONALD J. QUIGG

*Attesting Officer*

*Commissioner of Patents and Trademarks*